US005426087A

United States Patent [19]

Pope et al.

[11] Patent Number: 5,426,087

[45] Date of Patent: * Jun. 20, 1995

[54] THERMAL TRANSFER PRINTING RECEIVER

[75] Inventors: John A. Pope, Essex; Richard A. Hann, Suffolk, both of England

[73] Assignee: Imperial Chemical Industries, PLC, London, England

[ * ] Notice: The portion of the term of this patent subsequent to May 26, 2009 has been disclaimed.

[21] Appl. No.: 141,590

[22] Filed: Oct. 27, 1993

Related U.S. Application Data

[63] Continuation of Ser. No. 833,653, Feb. 11, 1992, abandoned, which is a continuation-in-part of Ser. No. 555,735, Jul. 23, 1990, Pat. No. 5,116,805.

[30] Foreign Application Priority Data

Feb. 11, 1991 [GB] United Kingdom ..... 9102801

[51] Int. Cl.[6] ..... B41M 5/035; B41M 5/38

[52] U.S. Cl. ..... 503/227; 428/195; 428/207; 428/913; 428/914

[58] Field of Search ..... 428/195, 913, 914, 207, 428/323; 503/227

[56] References Cited

U.S. PATENT DOCUMENTS

| | | | |
|---|---|---|---|
| 4,720,480 | 1/1988 | Ito et al. | 503/227 |
| 4,778,782 | 10/1988 | Ito et al. | 503/227 |
| 5,011,814 | 4/1991 | Harrison | 503/227 |
| 5,095,002 | 3/1992 | Beck et al. | 503/227 |
| 5,116,805 | 5/1992 | Pope et al. | 503/227 |
| 5,214,024 | 5/1993 | Beck et al. | 503/227 |

FOREIGN PATENT DOCUMENTS

| | | | |
|---|---|---|---|
| 409526 | 1/1991 | European Pat. Off. | B41M 5/00 |
| 444588 | 9/1991 | European Pat. Off. | B41M 5/00 |

*Primary Examiner*—Pamela R. Schwartz
*Attorney, Agent, or Firm*—Cushman, Darby & Cushman

[57] ABSTRACT

A receiver sheet for thermal transfer printing comprises a sheet-like substrate supporting a backcoat comprising a cross-linked organic polymer which is a reaction product of a polyalkylene glycol and a polyfunctional organic cross-linking agent reactive with the terminal hydroxyl groups of the polyalkylene glycol. This provides a surface which may be written on using aqueous inks, and to which water-activated adhesives may adhere. Suitable cross-linking agents are hexamethoxymethylmelamines or oligomers thereof. The backcoat is free from alkali metal salts to avoid retransfer problems, and may also be textured by particulate material embedded in the cross-linked polymer, to improve handling properties.

11 Claims, 1 Drawing Sheet

THERMAL TRANSFER PRINTING RECEIVER

This is a continuation of application Ser. No. 07,833,653, filed on Feb. 11, 1992 now abandoned, which was abandoned upon the filling hereof which is a continuation-in-part of Ser. No. 07,555,735, filed Jul. 23, 1990, now U.S. Pat. No. 5,116,805.

The invention relates to thermal transfer printing, and especially to receivers having backcoats which provide a surface that can effectively be written on using aqueous inks, and to which water-activated adhesives can adhere.

Thermal transfer printing is a generic term for processes in which one or more thermally transferable dyes are caused to transfer from a dyesheet to a receiver in response to thermal stimuli. Using a dyesheet comprising a thin substrate supporting a dyecoat containing one or more such dyes uniformly spread over an entire printing area of the dyesheet, printing can be effected by heating selected discrete areas of the dyesheet while the dyecoat is pressed against a dye-receptive surface of a receiver sheet, thereby causing dye to transfer to corresponding areas of that receiver. The shape of the pattern transferred is determined by the number and locations of the discrete areas which are subjected to heating. Full colour prints can be produced by printing with different coloured dyecoats sequentially in like manner, and the different coloured dyecoats are usually provided as discrete uniform print-size areas in a repeated sequence along the same dyesheet.

High resolution photograph-like prints can be produced by thermal transfer printing using appropriate printing equipment, such as a programmable thermal print head or laser printer, controlled by electronic signals derived from a video, computer, electronic still camera, or similar signal generating apparatus. A typical thermal print head, for example, has a row of individually operable tiny heaters spaced to print six or more pixels per millimeter, by providing very short hot pulses according to the electronic signals.

Receiver sheets comprise a substrate with a dye-receiving surface on one side. For substrates which are themselves dye-receptive polymers, the surface may simply be adapted by provision of a particularly smooth surface texture. However, in most cases receiver sheets comprise a substrate supporting a receiver coat of a dye-receptive composition containing a material having an affinity for the dye molecules, and into which they can readily diffuse when an area of dyesheet pressed against it is heated during printing.

Various sheet materials are used for the substrates, including cellulose fibre paper (usually with a polymer coating), thermoplastic films such as biaxially orientated polyethyleneterephthalate film, filled and/or voided thermoplastic films such as pearl film, and laminates of two or more such sheets.

Most receiver sheets also have one or more polymer backcoats on the side of the substrate remote from the image-receiving side. These may be provided to fulfil a number of different roles, including improvement of handling properties to enable adjacent sheets to slide more easily over one another instead of sticking together. Good handling properties are particularly important in automatic printers where sheets are to be fed individually to the printing station from a cassette or stack of such sheets, and such improved handling may be achieved by applying an antistatic backcoat comprising a cross-linked polymer matrix doped with an antistatic agent. Alternatively or additionally, the receiver may have a backcoat with a textured surface to reduce blocking, typically by having particulate material partially embedded in a cross-linked polymer matrix, suitably one doped with an antistatic agent as above. Examples of very effective antistatic backcoats are described, for example, in EP-A-409,526 (corresponding to U.S. Serial No. 07/555,735).

The photograph-like images that can be obtained with thermal transfer printing, open up many of the photography markets to the versatile techniques of electronic imaging. Thus immediate printing capability, for example, is useful for instant photograph booths, recording criminal or scientific evidence, or other occasional small quantity uses. Displays and holiday postcards can also take advantage of the ability to mix signals in electronic imaging, enabling portraits to be superimposed on prerecorded backgrounds, for example. For all these applications, and many others, the hydrophobic nature of the back of many current receiver sheets can be infuriating to the user, in their inability to accept aqueous-based inks and adhesives. Passport photographs on such materials cannot be endorsed on the back using normal aqueous inks, for example, and if one does find other means to enscribe a greetings card, a postage stamp will not stick to it. These problems can occur with many known receiver sheets, whether the substrate surface be exposed, or whether it be coated with a backcoat.

Antistatic backcoats described EP-A-409,526 comprise various crosslinked polymer matrices doped with alkali metal salt antistatic agents. We have now found that some (but not all) of the cross-linked polymer matrices referred to therein, also provide backcoats having good writability with aqueous inks and stickability with aqueous-based adhesives. Moreover, we have found that by selecting those cross-linked polymers that give good writability, there is generally surprisingly little (if any) deterioration in handling properties when the alkali metal salts are omitted (though that is not true for other matrices described therein), and that such omission may also bring a surprising benefit in improved retransfer resistance.

According to a first aspect of the present invention, a receiver sheet for thermal transfer printing comprises a substrate having a dye-receiving surface on one side and supporting a backcoat on the other, characterised in that the backcoat comprises a cross-linked organic polymer which is a reaction product of a polyalkylene glycol and a polyfunctional organic cross-linking agent reactive with the terminal hydroxyl groups of the polyalkylene glycol, said backcoat being free from alkali metal salts.

Turning first to the improved retransfer resistance, dye diffusion thermal transfer relies on dyes being sufficiently mobile to diffuse from one polymer environment into another when heat is applied by the printer. Like receiver layers, backcoats are generally polymer-based, and when they are held in contact with dye-containing prints for extended periods, eg during storage, some retransfer of the dye may occur, wherein dye molecules forming the printed image rediffuse out of the dye-receiving surface and into the backcoat of an adjacent sheet against which it is held during storage. This can happen even at the relatively low temperatures of ambient conditions, and is an unwanted side effect commonly observed when thermal transfer prints are stored in contact with each other, e.g. in an envelope, paper wallet or box.

It is not yet understood why the presence of lithium and other alkali metal salts should encourage retransfer when used in the presence of cross-linked polyalkylene glycols, but in all the compositions we have tested, there has been less tendency for retransfer to occur when all alkali metal salts have been omitted.

The other surprising observation on omitting the alkali metal salts, was that good handling properties were retained when the polymer matrix was a cross-linked polyalkylene glycol, generally with little readily observed deterioration. Even when the handling seemed not to be quite as good, no difficulty was experienced with automatic feeding from rolls of the receiver sheet, and the resulting prints had user-friendly handling. This was not the case with the cross-linked terpolymer of vinyl acetate, vinyl chloride and vinyl alcohol (VROH) specifically described in EP-A-409,526, where the addition of lithium and other alkali metal salts made very significant improvements in the handling properties.

Our preferred polyalkylene glycols are polyethylene glycols. We have also obtained useful results with polypropylene glycols, but as the series progresses, the moisture resistance is reduced and the strength of the coating decreases. Polyethylene glycols are readily available in molecular weights up to about 35,000 (weight average), but for the present application we prefer to use polyethylene glycols of average molecular weights of about 10,000 and under, to avoid coating problems that can occur with higher molecular weight materials, and we particularly prefer molecular weights of about 2,000 or less, to maintain a high level of cross-linking. (By "about" we mean to include such ranges as may be included by the manufacturers on either side of the nominal figure quoted.) Very low molecular weight polyethylene glycols, especially diethylene glycol and triethylene glycol are particularly suitable.

Common cross-linking agents capable of reacting with terminal hydroxyl groups of polyalkylene glycols, tend to be very reactive compounds with generally low shelf lives, though some may be functionally blocked. A readily available range of cross-linking agents which we find to be particularly effective and also user-friendly is the polyfunctional N-(alkoxymethyl)-amino resins. Examples of polyfunctional N-(alkoxymethyl)-amino resins include alkoxymethyl derivatives of urea, guanamine and melamine resins. Lower alkyl compounds (i.e. up to the $C_4$ butoxy derivatives) are available commercially and all can be used effectively, but the methoxy derivative is much preferred because of the greater ease with which its more volatile by-product (methanol) can be removed afterwards. Examples of the latter which are sold by American Cyanamid in different grades under the trade name Cymel, are the hexamethoxymethylmelamines, suitably used in a partially prepolymerised (oligomer) form to obtain appropriate viscosities. Hexamethoxymethylmelamines are 3–6 functional, depending on the steric hindrance from substituents and are capable of forming highly cross-linked materials using suitable acid catalysts, e.g. p-toluene sulphonic acid (PTSA).

Our preferred backcoats are textured, the texture being provided by particulate material within the size range 2 to 10 μm in diameter, embedded in the cross-linked polymer. The particulate material preferably comprises a mixture of small and large particles, at least 90% of the particles being within the size ranges 2–3 μm and 7–10 μm, with the particles distributed between the two size ranges according to a ratio of smaller to larger in the range 2:1 to 1:5. Suitable are silica particles such as Syloid 244 (Grace) with an average diameter of about 2 μm, and Gasil EBN (Crosfield) with an average diameter about 8–10 μm, but other particles, such as alumina and particulate polymeric materials, may also be used, as may mixtures of different particles falling within the size ranges stated above.

We find that such textured surfaces, especially with the larger size range of particulate materials, can improve tooth to give writability with pencils and ball-point pens. They can also bring advantages during manufacture, to the winding characteristics of long webs of receiver sheet. The roughness of such surfaces may also help to reduce slip when receiver sheets are being transported by the printer during printing, and improve handling properties by facilitating sliding of cut receiver sheets, one over the other, when stacked before or after printing.

The proportion of particulate material to the polymer matrix of the backcoat (which may include thermoplastic polymers in addition to the cross-linked thermoset material) can be varied over a considerable range and still provide a beneficial effect. A suitable range is from 0.5 to about 50% by weight of the total polymer content of the composition. Quantities less than 0.5% tend to have little effect, and we prefer a well loaded composition, the upper limit being determined by the required strength of the coating. Such coatings become crumbly if too much is added, and the optimum will vary with the particulate material used. Increasing the loading of the small size particles gives an increasingly mat finish, and good ink-absorption properties, while increasing the larger particles gives greater tooth, as described above.

Particularly preferred receiver sheets are those in which the backcoat has a textured surface and consists essentially of (a) a polymer composition comprising the cross-linked reaction product of a polyalkylene glycol with a polyfunctional N-(alkoxymethyl)amino resin, and (b) 0.5 to 50% by weight of the polymer composition, of particulate material within the size range 2 to 10 μm dispersed throughout the cross-linked polymer.

The polymer composition can include other polymeric materials, including both thermoset and thermoplastic polymers; but to maintain the writability and stickability of the resulting backcoat, the cross-linked polyalkylene glycol reaction product preferably provides about half or more of the polymer composition. Particularly useful for modifying the brittleness of the backcoat, especially for use in tightly wound rolls, are thermoplastic polymers such as polymethylmethacrylate. However, unless an application requires some particular characteristic to be modified, we prefer that the polymer constituent of the backcoat shall consist entirely of the cross-linked reaction products of the polyalkylene glycols, thereby to maximise the benefits thereof.

As described above, retransfer is a problem associated with dye-diffusion thermal transfer technology, which relies on dyes being able to diffuse into the receiver, and hence being susceptible to diffusion out of it again. It is thus a problem that is not experienced in other forms of thermal transfer, such as sublimation transfer in which dye vapour condenses from the surrounding atmosphere onto a receiving surface, or melt transfer (sometimes referred to as mass transfer) in which an ink sheet has an ink coat of a dye or pigment dispersed in a meltable resin, which when melted carries the dye or pigment with it onto the receiver surface. Because dye-diffusion transfer requires this ability to diffuse through the receiver, most receivers differ from those used for such other techniques by the provision of a special receiver coat having such diffusion properties. Such dye-diffusion can be driven by a concentration gradient, so the resistance of the present backcoat to retransfer of the dye molecules, is particularly pertinent to receiver sheets specifically adapted for dye-diffusion transfer by the provision of a receiver coat. Thus our preferred receiver is one wherein the dye-receiving surface is provided by a receiver coat supported on the substrate, the receiver coat comprising a dye-receptive composition containing a material having an affinity for the dye molecules, and through which they can diffuse when driven by a concentration gradient.

Receiver sheets according to the first aspect of the invention are particularly suited to use in the configuration of long strips wound as a roll onto a core, e.g. in a cassette from which the printer may withdraw appropriate lengths as required. Most of the present receiver sheets can also be cut into individual print size portions, and sold as a stack of receivers, whether in a cartridge adapted for an automatic feed printer, or as a refill pack. However, in the latter case it is desirable to select receivers in which the backcoat polymeric material is predominantly, or preferably entirely, consisting of the cross-linked polyalkylene glycols.

To reflect its particular suitability to roll-feed machines, we also provide according to a second aspect of the invention, a receiver sheet according to the first aspect of the invention, having the configuration of an elongated strip of multiple-print length, wound into a roll and packaged for use in a continuous feed thermal transfer printer. This enables the receiver sheet to be fed to the printing station as required, without precut sheets having to slide one over the other, and sticking and jamming the printer; and once printed taking advantage of the lower retransfer properties obtained in the absence of alkali metal antistatic agents according to the present invention. Moreover, once the receivers have been transfer printed, the present backcoat enables the backs of the prints to be individually endorsed with aqueous inks immediately they emerge from the printer, or indeed at any time later.

As a third aspect of the invention, we provide a receiver sheet as described above, wherein the dye-receiving surface is provided by a dye-receptive composition, characterised in that the receiver has been printed by dye-diffusion thermal transfer printing and as a consequence the dye-receptive composition contains transferred image-forming dyes diffused therein.

BRIEF DESCRIPTION OF THE DRAWINGS

The invention is illustrated by reference to specific embodiments shown in the accompanying drawings, in which.

Figure 1:
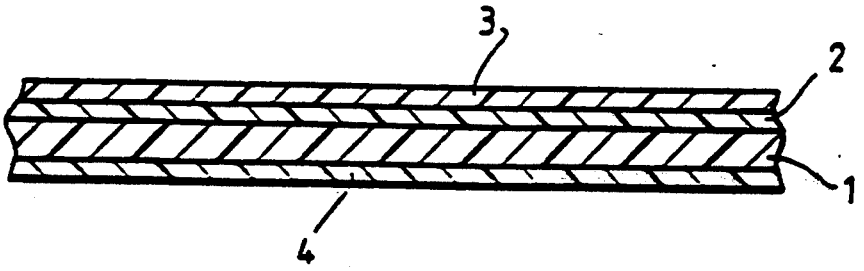
FIG. 1 is a diagrammatical representation of a cross section through a receiver sheet according to the present invention.

The sheet shown in FIG. 1 has a substrate of biaxially orientated polyethyleneterephthalate film 1. Coated onto one side of this (i.e. the dye-receiving side) is a conducting undercoat 2, overlain by a receptive layer 3. On the other side remote from the dye-receiving side is a backcoat 4 according to the present invention.

Figure 2:
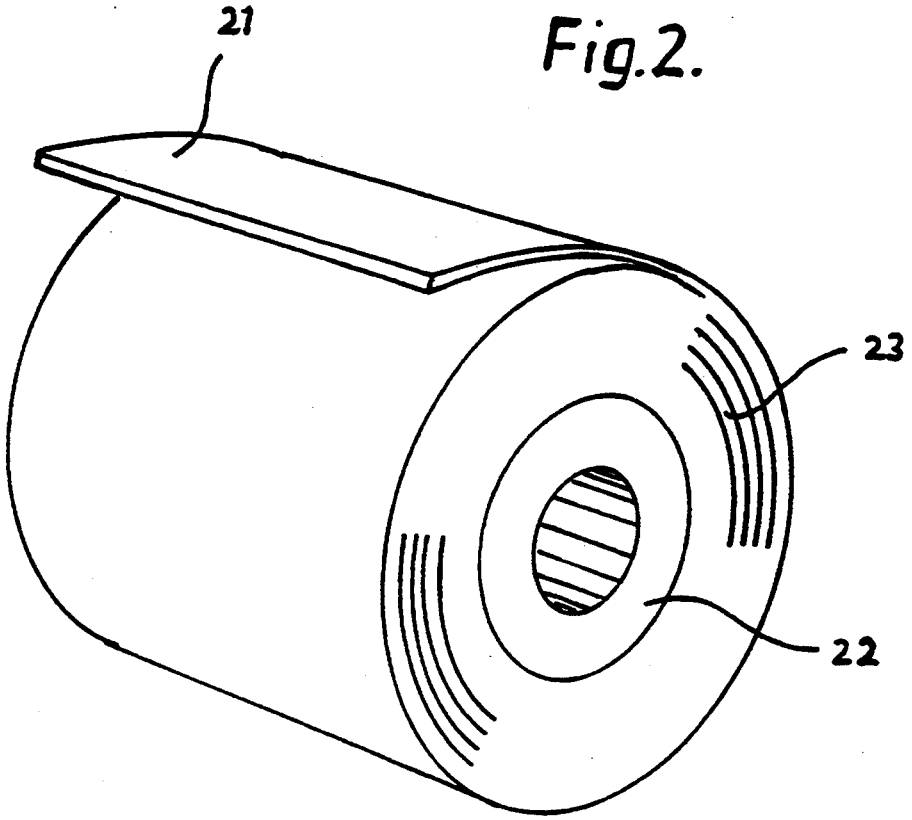
FIG. 2 is a similar section through a roll of such receiver sheet.

In FIG. 2, a strip 21 of the same sheet is shown wound around a core 22, to form a roll 23 suitable for use in a printer with a continuous receiver feed mechanism.

EXAMPLES

The invention is illustrated by a series of receiver sheets using various coating compositions, the receiver sheets being cut lengths of that shown in the drawings. In each case except Example 2, the substrate was a large web of opaque white Melinex 990 biaxially orientated polyester film (ICI). A backcoat was first applied, followed by a conductive undercoat and its overlying receiver layer on the other side, as described below.

Examples 1 & 1a

The first coat to be applied to the web was the backcoat. One surface of the web was first chemically etched to give a mechanical key, and (for Example 1) a backcoat coating composition prepared from the following:

| | |
|---|---|
| Digol | 5.7 parts by weight |
| Cymel 303 | 15 parts by weight |
| amine-blocked PTSA | 10 parts by weight |
| Diagon MG102 | 22 parts by weight |
| Gasil EBN | 2 parts by weight |
| Syloid 244 | 8 parts by weight |

(Gasil EBN and Syloid 244 are brands of silica particles sold by Crosfield and Grace respectively, and Diakon MG102 is a polymethylmethacrylate sold by ICI).

The backcoat composition was prepared as two solutions, these being a thermoset precursor solution, and a filler dispersion containing the acid catalyst. Shortly before use, the two solutions were mixed to give the above composition. This was then machine coated onto the etched surface, dried and cured to form a 1.5–2 μm thick backcoat.

For the receiver side of the substrate, a conductive undercoat composition was prepared consisting of:

| | |
|---|---|
| methanol | (solvent) |
| PVP K90 | 20 parts by weight |
| Cymel 303 | 40 parts by weight |
| K-Flex 188 | 5 parts by weight |
| Digol | 15 parts by weight |
| PTSA | 20 parts by weight |
| $LiOH.H_2O$ | 3.2 parts by weight |

(K-Flex is a polyester polyol sold by King Industries and PVP is polyvinyl pyrrolidone, both being added to adjust the coating properties.)

This composition was prepared initially as separate solutions of the reactive ingredients, these being mixed shortly before use. This composition was then machine coated onto the opposite side of the substrate from the backcoat, dried and cured at 110° C. to give a dry coat thickness of about 1 μm.

The receiver layer coating composition also used Cymel 303 and an acid catalysed system compatible with the conductive undercoat, and consisted of:

| | |
|---|---|
| toluene/MEK | 60/40 solvent mixture |
| Vylon 200 | 100 parts by weight |
| Tegomer HSi 2210 | 0.7 parts by weight |
| Cymel 303 | 1.4 parts by weight |
| Tinuvin 900 | 1.0 parts by weight |
| Nacure 2530 | 0.2 parts by weight |

(Tegomer HSi 2210 is a bis-hydroxyalkyl polydimethylsiloxane, cross-linkable by the Cymel 303 under acid conditions to provide a release system effective during printing, being sold by Th Goldschmidt.)

This coating composition was made by mixing three functional solutions, one containing the dye-receptive Vylon and the Tinuvin UV absorber, a second containing the Cymel cross linking agent, and the third containing both the Tegomer silicone release agent and the Nacure solution to catalyse the crosslinking polymerisation between the Tegomer and Cymel materials. Using in-line machine coating, the receiver composition was coated onto the conductive undercoat, dried and cured 140° C. to give a dye-receptive layer about 4 μm thick.

Examination of the coated web showed that the highly cross-linked backcoat had proved stable to the solvents and elevated temperatures used during the subsequent provision of the other two coatings.

For Example 1a, a further receiver web was also prepared in the manner of the above, except that the backcoat composition comprised three elements, the third being a solution of lithium nitrate sufficient to contribute 1 part by weight of lithium nitrate in the total composition.

Handling, writability and stickability tests were then carried out as described below for Examples 1, 1a, 2, & 2a collectively.

Example 2

The above Examples were repeated using a transparent biaxially orientated polyester film instead of the white substrate. In each case, a backcoat was first applied to one sider followed by a conductive undercoat being applied to the other, both of these having the same compositions as in Examples 1 and 1a respectively. The receiver coats were modified, however, the compositions used being:

| | |
|---|---|
| toluene/MEK | 60/40 solvent mixture |
| Vylon 200 | 100 parts by weight |
| Tegomer H-Si 2210 | 1.3 parts by weight |
| Cymel 303 | 1.8 parts by weight |
| Tinuvin 900 | 2.0 parts by weight |
| Nacure 2530 | 0.2 parts by weight |

The receiver coat was applied and dried as for Example 1, and a comparative transparent sheet containing lithium nitrate (Example 2a), was also prepared as before. Samples of the resulting sheets resulting from Examples 1, 1a, 2, and 2a were evaluated.

Evaluation—writability and stickability

Each of the receiver webs was cut into standard sizes, and fed through a thermal transfer printer from a stack. Single sheets were fed from the stack in turn, and printed with a full colour image. No handling problems were experienced during printing, and any subjective handling improvements which may have been noticed when changing from Example 1 to 1a, or from 2 to 2a, was small.

The prints were tested for writability using an HB pencil, and using a pen filled with aqueous ink. In both cases no difficulty was experienced with either set of receivers.

To test whether such receivers could be used as postcards, postage stamps were moistened, and applied to the backcoats. When dry they could not readily be removed without damage.

Commercial receivers having a standard crosslinked polymer backcoat were printed in the same manner, as a control. Writing could be effected with the pencil, but the aqueous ink agglomerated and ran off, that which dried first leaving no more than unreadable blobs. These also failed the postage stamp test, the stamp tending to fall off when it dried.

Evaluation—retransfer

The prints were stacked all facing the same way, such that the printed surface of one was lying against the backcoat of that overlying it. The stack was then left for several days under accelerated aging conditions of 45° C. and 85% relative humidity. Receivers of Examples 1 and 2, showed only slight discoloration on their backcoats. Receivers of Examples 1a and 2a, though not particularly discoloured, did show more noticeable evidence of retransfer.

Examples 3 to 9 and 3a to 9a

In the table below are provided further backcoat compositions. These have been selected to show a wide range of polyalkylene glycols that can be used, including polypropylene glycol and a series of polyethylene glycols ranging from those having a high molecular weight, down to diethylene glycol. The percentages quoted are by weight of the composition including the antistatic agent but excluding the acid catalyst. In preparing the compositions for Examples 3 to 9, separate solutions of the polyalkylene glycol and the polyfunctional cross-linking agent were made up and mixed Just before use, in the manner of the previous Examples. For the comparative Examples 3a to 9a, a further solution containing the alkali metal salt was also prepared and mixed with the other two just before use. In the table below, the following abbreviations and trade names have been used:

PPG is polypropylene glycol,
PEG is polyethylene glycol,
Trigol is triethylene glycol
Digol is diethylene glycol
Trillate is lithium trifluoro methane sulphate,
KFBS is potassium nona fluoro-1-butane sulphonate,
PTSA is p-toluene sulphonic acid (amine blocked).

TABLE

| Example | composition |
|---|---|
| 3 | 37% PPG<br>37% Cymel 303 |
| (3a) | (26% Triflate) +<br>5% phthalic acid |
| 4 | 37% PEG 400<br>37% Cymel 303 |
| (4a) | (26% Triflate) +<br>5% phthalic acid |
| 5 | 37.5% PEG 400<br>31% Cymel 303 |
| (5a) | (31.5% Trillate) +<br>5% phthalic acid |
| 6 | 24% PEG 200<br>40% Cymel 303 |
| (6a) | (36% KSCN) +<br>5% phthalic acid |
| 7 | 19% Trigol |

TABLE-continued

| Example | composition |
|---|---|
| | 5% Cymel 303 |
| (7a) | (46% Li PTSA) + 5% PTSA |
| 8 | 18% Digol 47% Cymel 303 |
| (8a) | (35% KFBS) + 5% phthalic acid |
| 9 | 21% Digol 55% Cymel 303 |
| (9a) | (24% $LiNO_3$) + 5% phthalic acid |

The compositions shown in the above table, provide the basic polymer precursors, antistatic agents for the comparison Examples, and acid catalysts used in the composition. To this, if desired (end preferably), may be added a filler dispersion when the solutions are mixed shortly before coating onto the receiver substrate and drying. The filler may be a mixture of species as shown in Example 1, or a single species.

After printing, endorsement on the backcoats was attempted, using an aqueous based ink. No real problems were found with any of the samples tested. These tests were too subjective to place all the samples in order of merit, although particularly good results were consistently obtained with cross-linked diethylene glycol as the backcoat polymer. By contrast, a sheet of uncoated Melinex 990 could not readily be endorsed using the same ink.

As with Examples 1 and 2, some of the samples were also tested for their ability to accept water-activated adhesives. Postage stamps (or their unprinted edge strips) were moistened with water and pressed against the backcoats. In every case good adhesion was obtained.

When evaluated for retransfer, the results were consistent in that those without any alkali metal salts were again less susceptible to retransfer problems than those containing such salts.

Example 10

This further Example is provided to illustrate the use of particulate materials other than silica. In a receiver web as described in Example 1, with the receiver and antistatic interlayer remaining unchanged, the backcoat composition (which again is applied, dried and cured first) has the following composition:

| | |
|---|---|
| PEG 600 | 38 parts by weight |
| Cymel 303 | 38 parts by weight |
| Pergopak M3 | 15 parts by weight |
| Gasil EBN | 5 parts by weight |
| phthalic acid | 4 parts by weight |

Pergopak M3 is a micronised urea formaldehyde polymer, manufactured by Martinswerk, and provides the bulk of the particulate filler. However, some of the larger silica particles (Gasil EBN) have been retained to give sufficient tooth for effective writing with pencils and ball point pens. The good aqueous wettability of such compositions again provides a surface that can effectively be written on using aqueous inks, and to which water-activated adhesives can adhere.

We claim:

1. A receiver sheet for thermal transfer printing comprising a substrate having a dye-receiving surface on one side and supporting a backcoat on the other, characterised in that the backcoat comprises a cross-linked organic polymer which is a reaction product of a polyalkylene glycol and a polyfunctional organic cross-linking agent reactive with the terminal hydroxyl groups of the polyalkylene glycol, said backcoat being free from alkali metal salts.

2. A receiver sheet as claimed in claim 1, wherein the polyalkylene glycol is a polyethylene glycol.

3. A receiver sheet as claimed in claim 2, wherein the polyethylene glycol is selected from diethylene glycol and triethylene glycol.

4. A receiver sheet as claimed in claim 1, wherein the cross-linked polymer of the backcoat is an acid catalysed reaction product of the polyalkylene glycol with a polyfunctional N-(alkoxymethyl)amino resin as cross-linking agent.

5. A receiver sheet as claimed in claim 4, characterised in that the crosslinking agent is a hexamethoxymethylmelamine or oligomer thereof.

6. A receiver sheet as claimed in claim 4, wherein the backcoat is textured by particulate material embedded in the cross-linked polymer.

7. A receiver sheet as claimed in claim 6, wherein the backcoat consists essentially of (a) the cross-linked polymer being the reaction product of a polyalkylene glycol with a polyfunctional N-(alkoxymethyl)amino resin, and (b) 0.5 to 50% by weight of the polymer of a particulate material within the size range 2 to 10 μm dispersed throughout the cross-linked polymer.

8. A receiver sheet as claimed in claim 6 or claim 7, wherein the particulate material comprises a mixture of small and large particles, at least 90% of the particles being within the size ranges 2–3 μm and 7–10 μm, with the particles distributed between the two size ranges according to a ratio of smaller to larger in the range 2:1 to 1:5.

9. A receiver sheet as claimed in any one of claims 1 to 7, wherein the dye-receiving surface is provided by a receiver coat supported on the substrate, the receiver coat comprising a dye-receptive composition containing a material having an affinity for the dye molecules, and through which they can diffuse when driven by a concentration gradient.

10. A receiver sheet as claimed in any one of claims 1 to 7, having the configuration of an elongated strip of multiple-print length, wound into a roll and packaged for use in a thermal transfer printer.

11. A receiver sheet as claimed in any one of claims 1 to claim 7, wherein the dye-receiving surface is provided by a dye-receptive composition, characterisd in that the receiver has been printed by dye-diffusion thermal transfer printing and as a consequence the dye-receptive composition contains transferred image-forming dyes diffused therein.

* * * * *